US011535970B2

(12) United States Patent
Seereddy et al.

(10) Patent No.: US 11,535,970 B2
(45) Date of Patent: Dec. 27, 2022

(54) WASHING MACHINE APPLIANCE HAVING A REMOVABLE AGITATOR

(71) Applicant: Haier US Appliance Solutions, Inc., Wilmington, DE (US)

(72) Inventors: Veera Venkata Anil Bhaskar Prasad Seereddy, Hyderabad (IN); Venkata Chakradhar Rangu, Hyderabad (IN); Neelapala Gopinath Yadav, Hyderabad (IN); Kalyana Mallavarapu, Hyderabad (IN); Srikanth Gopireddy, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/224,637

(22) Filed: Apr. 7, 2021

(65) Prior Publication Data

US 2022/0325462 A1 Oct. 13, 2022

(51) Int. Cl.

| | |
|---|---|
| ***D06F 37/40*** | (2006.01) |
| ***D06F 37/24*** | (2006.01) |
| ***D06F 23/04*** | (2006.01) |

(52) U.S. Cl.

CPC ..... *D06F 37/40* (2013.01); *D06F 23/04* (2013.01); *D06F 37/24* (2013.01)

(58) Field of Classification Search

None

See application file for complete search history.

(56) References Cited

U.S. PATENT DOCUMENTS

| | | | | |
|---|---|---|---|---|
| 3,511,067 | A | 5/1970 | Matzen | |
| 3,641,791 | A | 2/1972 | Jacobsen | |
| 3,648,486 | A * | 3/1972 | Rosinski, Jr. | D06F 13/00 68/4 |
| 3,805,559 | A | 4/1974 | Marti | |
| 4,077,239 | A * | 3/1978 | Platt | D06F 13/02 68/184 |
| 10,787,761 | B2 | 9/2020 | Czarnecki | |

FOREIGN PATENT DOCUMENTS

| | | | | |
|---|---|---|---|---|
| WO | WO-2013088426 A2 * | 6/2013 | ..... | D06F 37/16 |

* cited by examiner

*Primary Examiner* — Cristi J Tate-Sims
(74) *Attorney, Agent, or Firm* — Dority & Manning, P.A.

(57) ABSTRACT

A washing machine appliance may include a tub, a basket, an impeller base, an extended post, and a connector bar. The basket may be rotatably positioned within the tub. The impeller base may include a mounting face disposed radially inward from one or more impeller fins. The mounting face may include a mounting bracket defining one or more attachment slots. The extended post may be removably attached to the impeller base and include a base body, an auger fin, and a mating face. The base body may define an interior cavity. The auger fin may extend radially from the base body. The mating face may include a mating collar defining one or more attachment rails corresponding to the one or more attachment slots. The connector bar may be selectively received within the interior cavity.

20 Claims, 12 Drawing Sheets

WASHING MACHINE APPLIANCE HAVING A REMOVABLE AGITATOR

FIELD OF THE INVENTION

The present subject matter relates generally to washing machine appliances and an agitation element for the same.

BACKGROUND OF THE INVENTION

A vertical axis washing machine appliance generally includes a tub with a basket rotatably positioned within the tub. Articles to be washed, such as clothes, are placed in the machine's basket. An agitation element can be included in the tub, and can rotate to move articles within the basket to facilitate washing. Agitation elements are typically impellers, single-action agitation elements, or dual-action agitation elements. Generally, such an agitation element reciprocates about a rotation axis (e.g., vertical axis) within the machine's basket. In some instances, fins extend from a rigid shaft of the agitation element to contact and move the articles. The surface of the basket and gravity may be used in conjunction with such agitation elements to impart a circular motion of the articles, known as "turnover," from a top of the basket, to a bottom of the basket, and back up to the top of the basket.

Different agitation elements typically come with different advantages and disadvantages. In the case of single-action and dual-action agitation elements, users may perceive greater agitation and turnover of articles during a washing operation or cycle than with an impeller agitation element. In the case of impeller agitation elements, a greater volume or portion of the wash basket may be available or better able to handle bulky items (e.g., towels, bedding, etc.) than a single-action or dual-action agitation element.

Generally, a consumer or user has to decide which type of agitation element would be most desired at the time of purchase. This obviously limits the user's choice and ability to wash various loads. As a result, it would be useful if a user could have greater flexibility, particularly with regard to the type of agitation element that is used for any given washing operation or wash cycle. Therefore, it would be advantageous to provide a washing machine appliance or assembly wherein an agitation element (or portions thereof) could be readily removed between discrete washing operations or wash cycles (e.g., by a user without the use of any tools).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a tub, a basket, an impeller base, an extended post, and a connector bar. The basket may be rotatably positioned within the tub. The impeller base may be rotatably mounted within the basket and define a rotation axis. The impeller base may include one or more impeller fins extending radially outward from the rotation axis, and a mounting face disposed radially inward from the one or more impeller fins. The mounting face may include a mounting bracket defining one or more attachment slots extending vertically. The extended post may be removably attached to the impeller base to rotate therewith. The extended post may include a base body, an auger fin, and a mating face. The body base may extend along the rotation axis between a bottom end proximal to the impeller base and a top end distal to the impeller base. The base body may define an interior cavity from the bottom end to the top end. The auger fin may extend radially from the base body between the bottom end and the top end. The mating face may be disposed on the bottom end. The mating face may include a mating collar defining one or more attachment rails corresponding to and selectively received within the one or more attachment slots. The connector bar may be selectively received within the interior cavity and extend along the rotation axis between a lower end and an upper end. The lower end may include a connector tab to slidably engage the impeller base. The connector tab may hold the extended post against the impeller base.

In another exemplary aspect of the present disclosure, a washing machine appliance is provided. The washing machine appliance may include a tub, a basket, an impeller base, an extended post, a connector bar, and a post cap. The basket may be rotatably positioned within the tub. The impeller base may be rotatably mounted within the basket and define a rotation axis. The impeller base may include one or more impeller fins extending radially outward from the rotation axis, and a mounting face disposed radially inward from the one or more impeller fins. The mounting face may include a mounting bracket defining one or more attachment slots extending vertically. The extended post may be removably attached to the impeller base to rotate therewith. The extended post may include a base body, an auger fin, and a mating face. The base body may extend along the rotation axis between a bottom end proximal to the impeller base and a top end distal to the impeller base. The base body may define an interior cavity from the bottom end to the top end. The auger fin may extend radially from the base body between the bottom end and the top end. The mating face may be disposed on the bottom end. The mating face may include a mating collar defining one or more attachment rails corresponding to and selectively received within the one or more attachment slots. The attachment rails may extend radially outward from the mating collar. The connector bar may be selectively received within the interior cavity and extend along the rotation axis between a lower end and an upper end. The lower end may include a connector tab to slidably engage the impeller base. The connector tab may hold the extended post against the impeller base. The post cap may selectively cover the interior cavity of the extended post at the top end.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
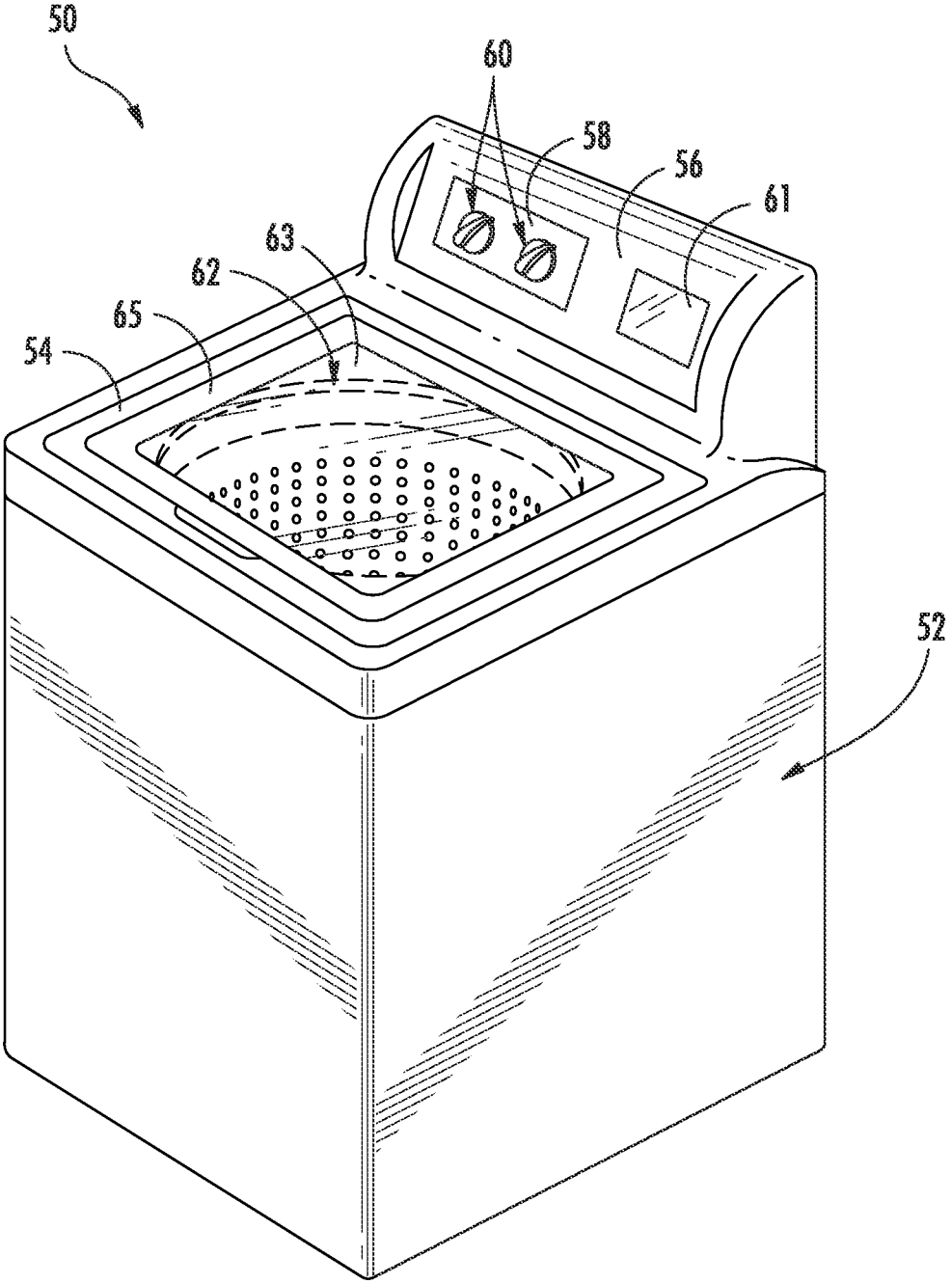
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The phrase "in one embodiment," does not necessarily refer to the same embodiment, although it may. The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
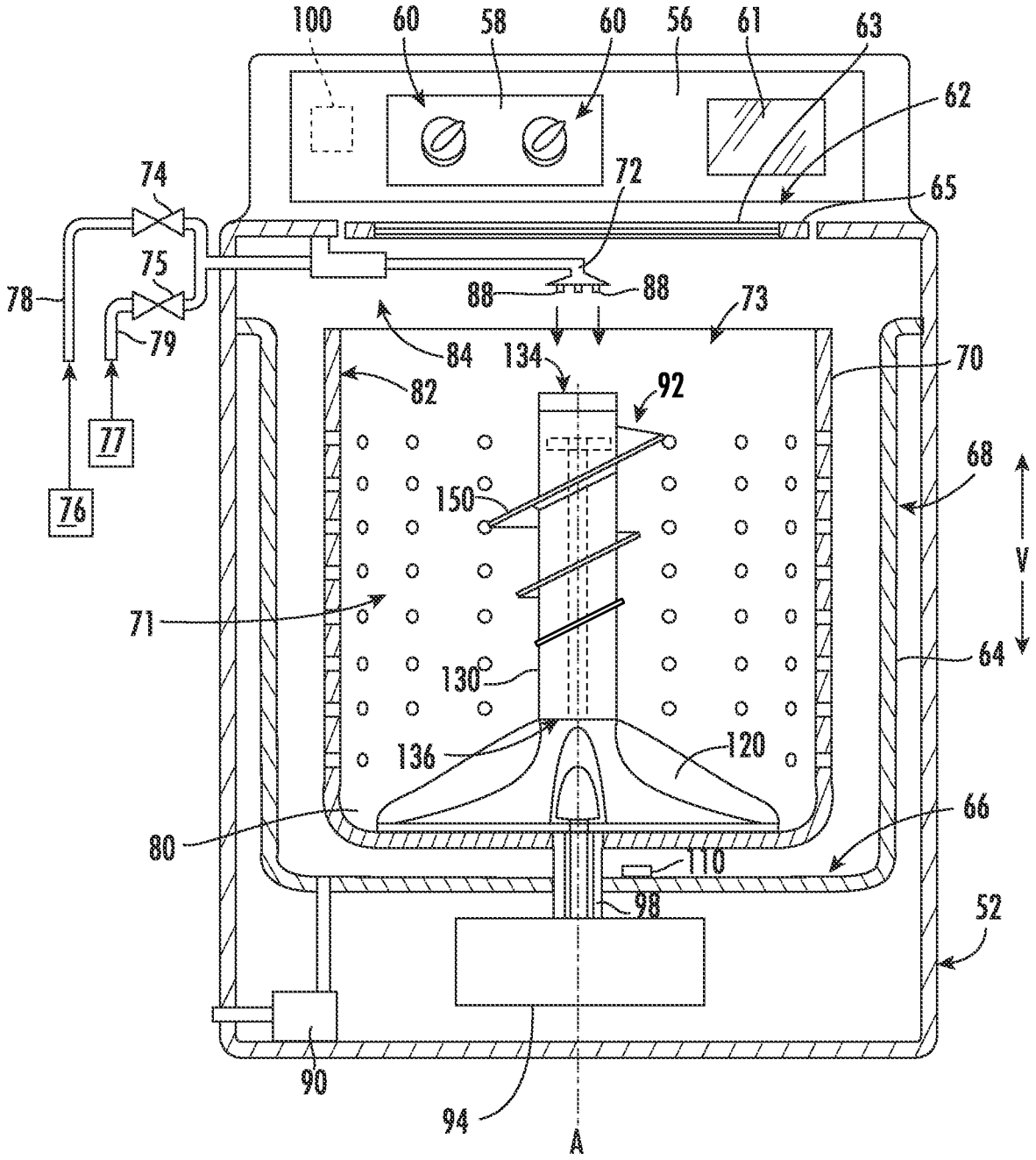
FIG. 2 provides a sectional elevation view of the exemplary washing machine appliance of FIG. 1.
Figure 3:
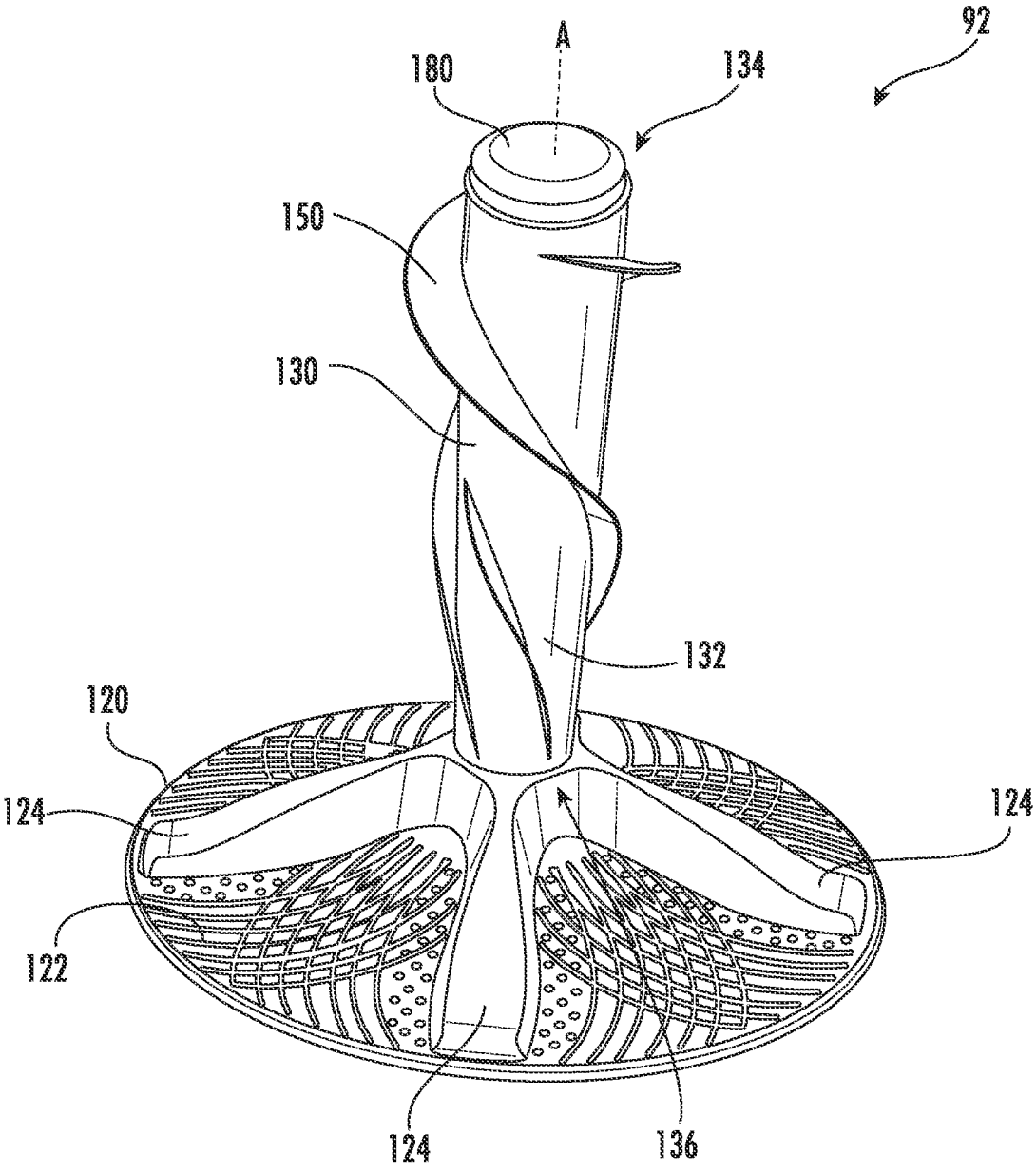
FIG. 3 provides a perspective view of an agitation element, in isolation, according to exemplary embodiments of the present disclosure.
Figure 4:
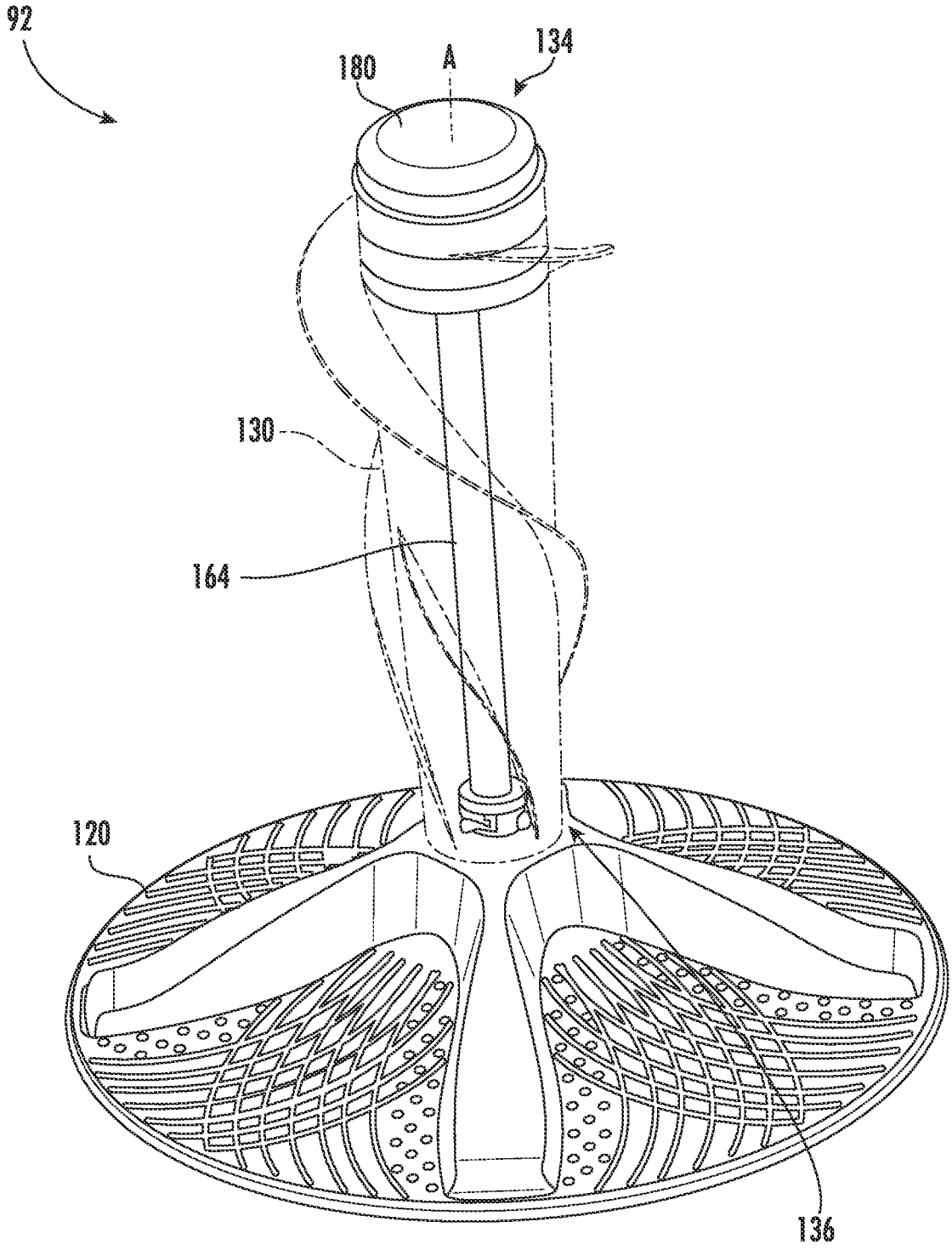
FIG. 4 provides another perspective view of an agitation element, in isolation, according to exemplary embodiments of the present disclosure.
Figure 5:
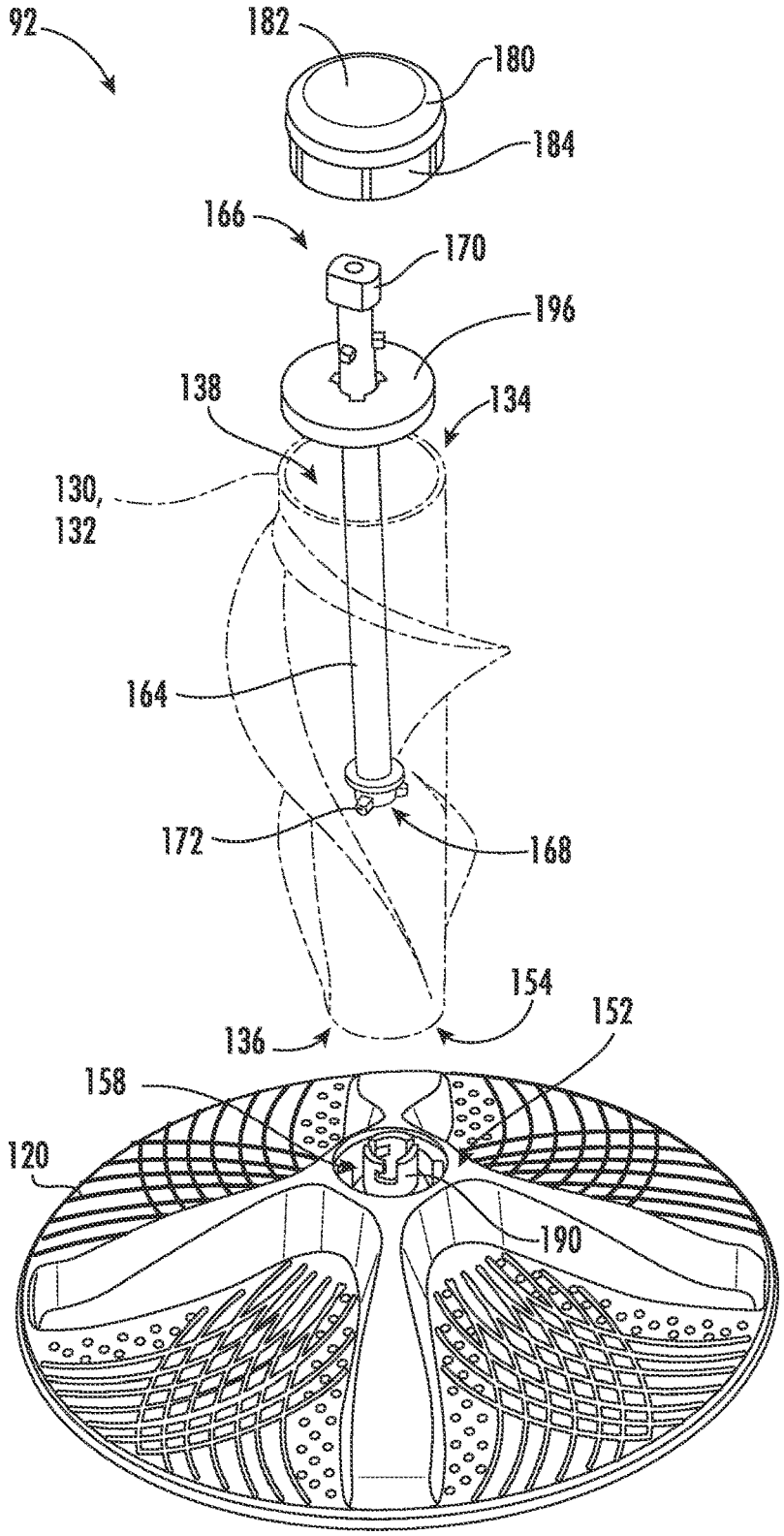
FIG. 5 provides an exploded perspective view of the exemplary agitation element of FIG. 4.
Figure 6:
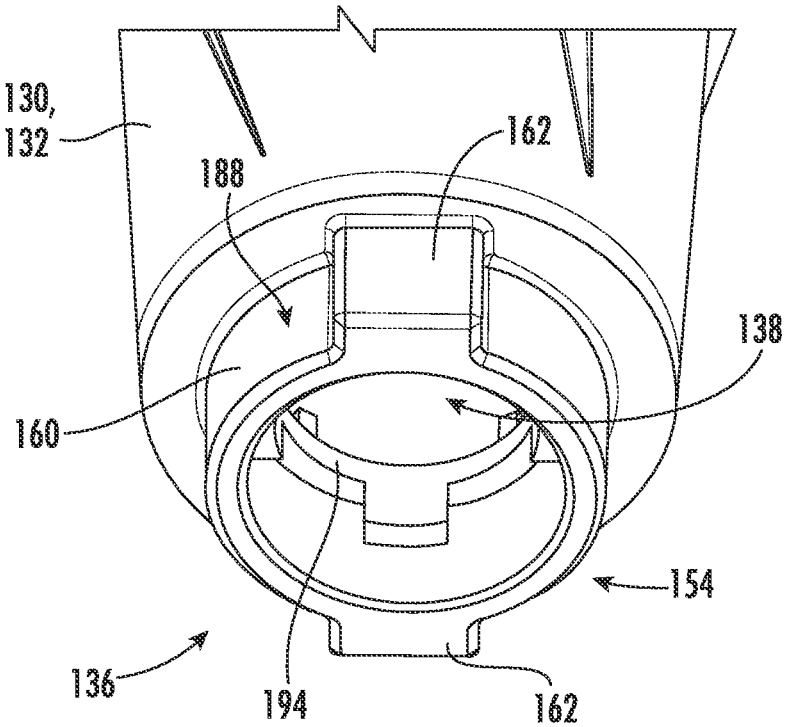
FIG. 6 provides a bottom perspective view of a portion of an extended post of the exemplary agitation element of FIG. 4.
Figure 7:
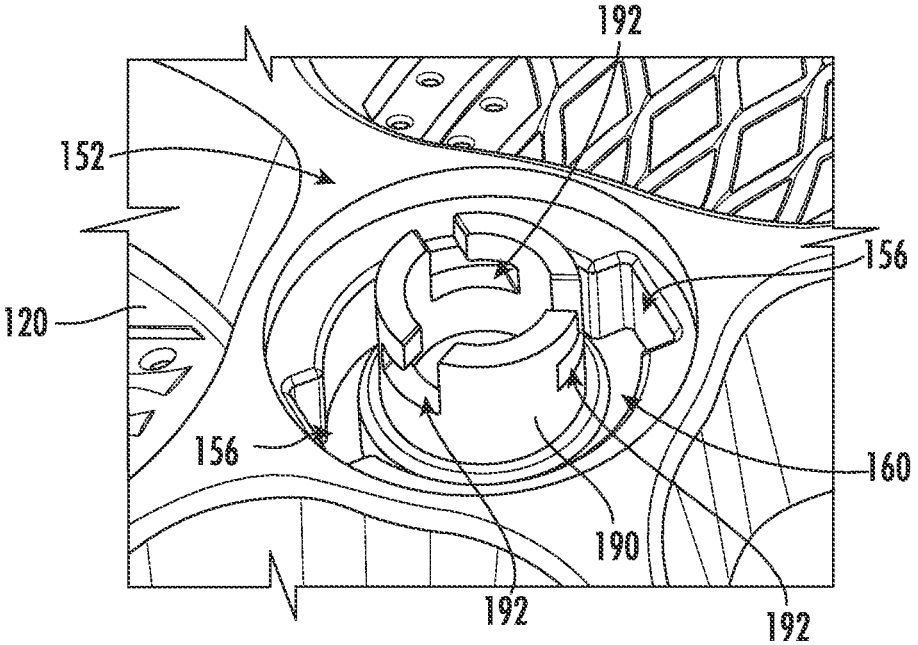
FIG. 7 provides a top perspective view of a portion of an impeller body of the exemplary agitation element of FIG. 4.
Figure 8:
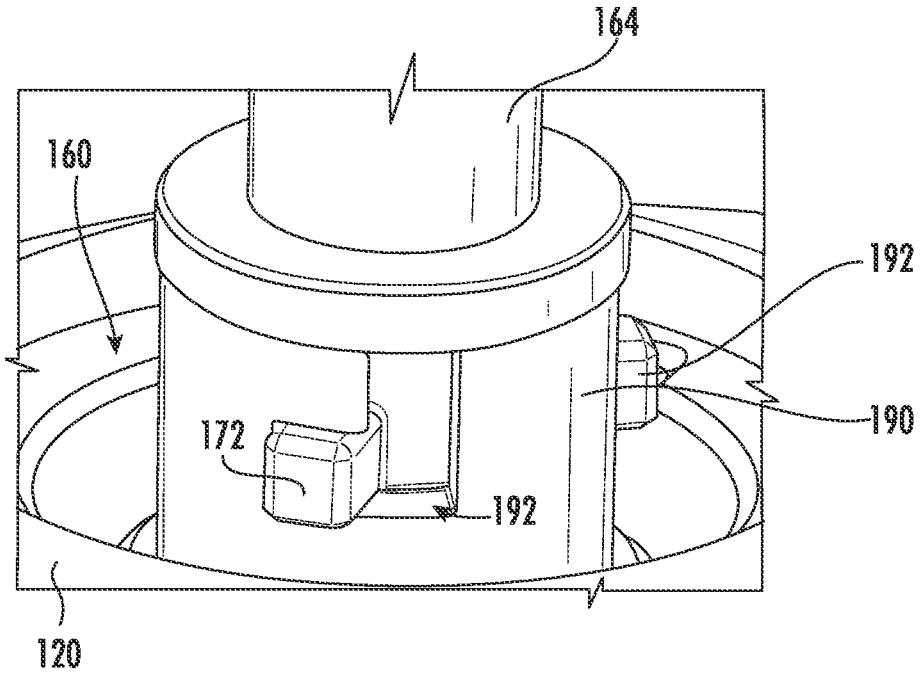
FIG. 8 provides a perspective view of a portion of connector bar attached to the impeller base of the exemplary agitation element of FIG. 4.
Figure 9:
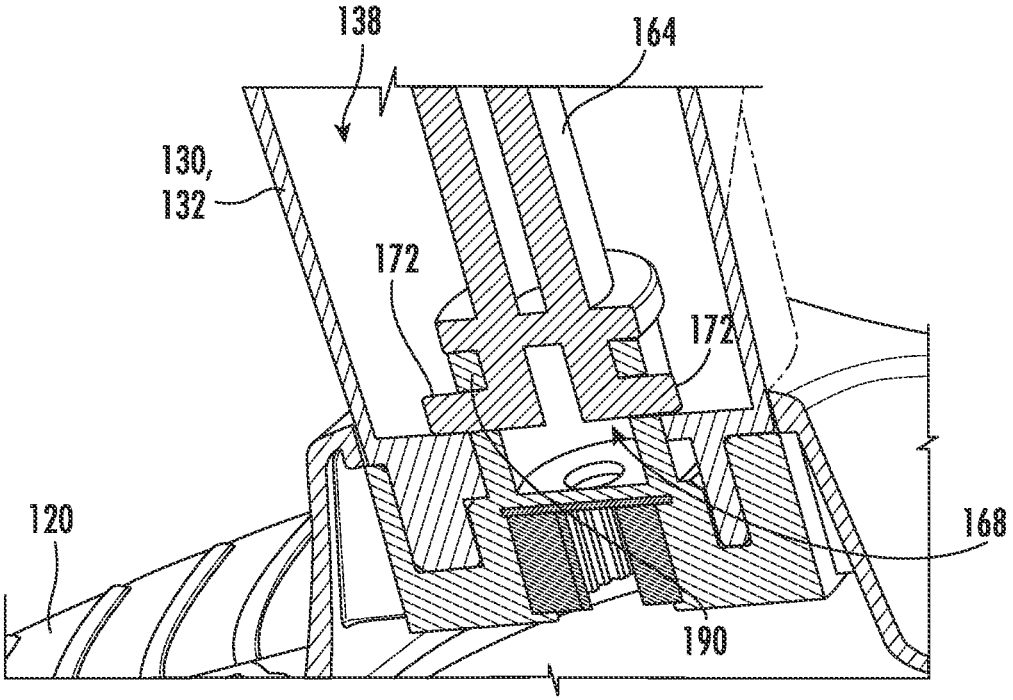
FIG. 9 provides a sectional perspective view of a bottom portion of the extended post attached to the impeller base of the exemplary agitation element of FIG. 4.
Figure 10:
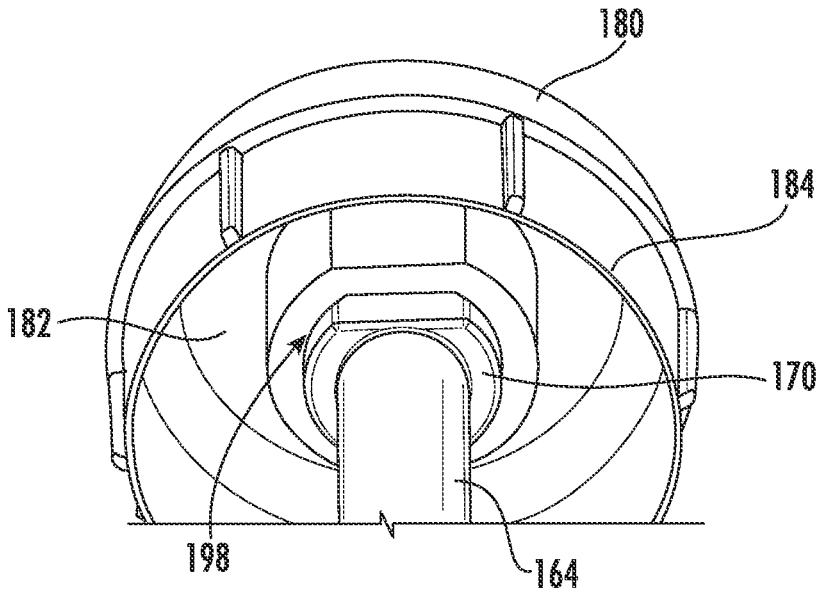
FIG. 10 provides a bottom perspective view of a portion of the connector bar and a post cap of the exemplary agitation element of FIG. 4.
Figure 11:
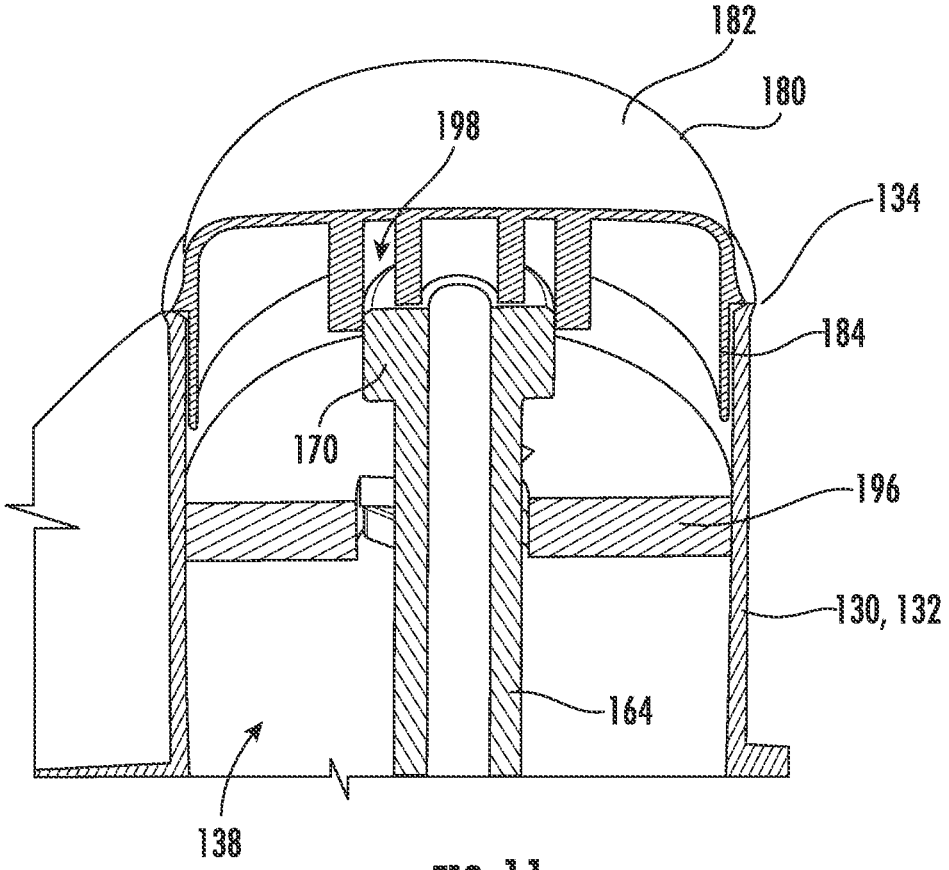
FIG. 11 provides a sectional perspective view of a top portion of the extended post attached to the impeller base of the exemplary agitation element of FIG. 4.
Figure 12:
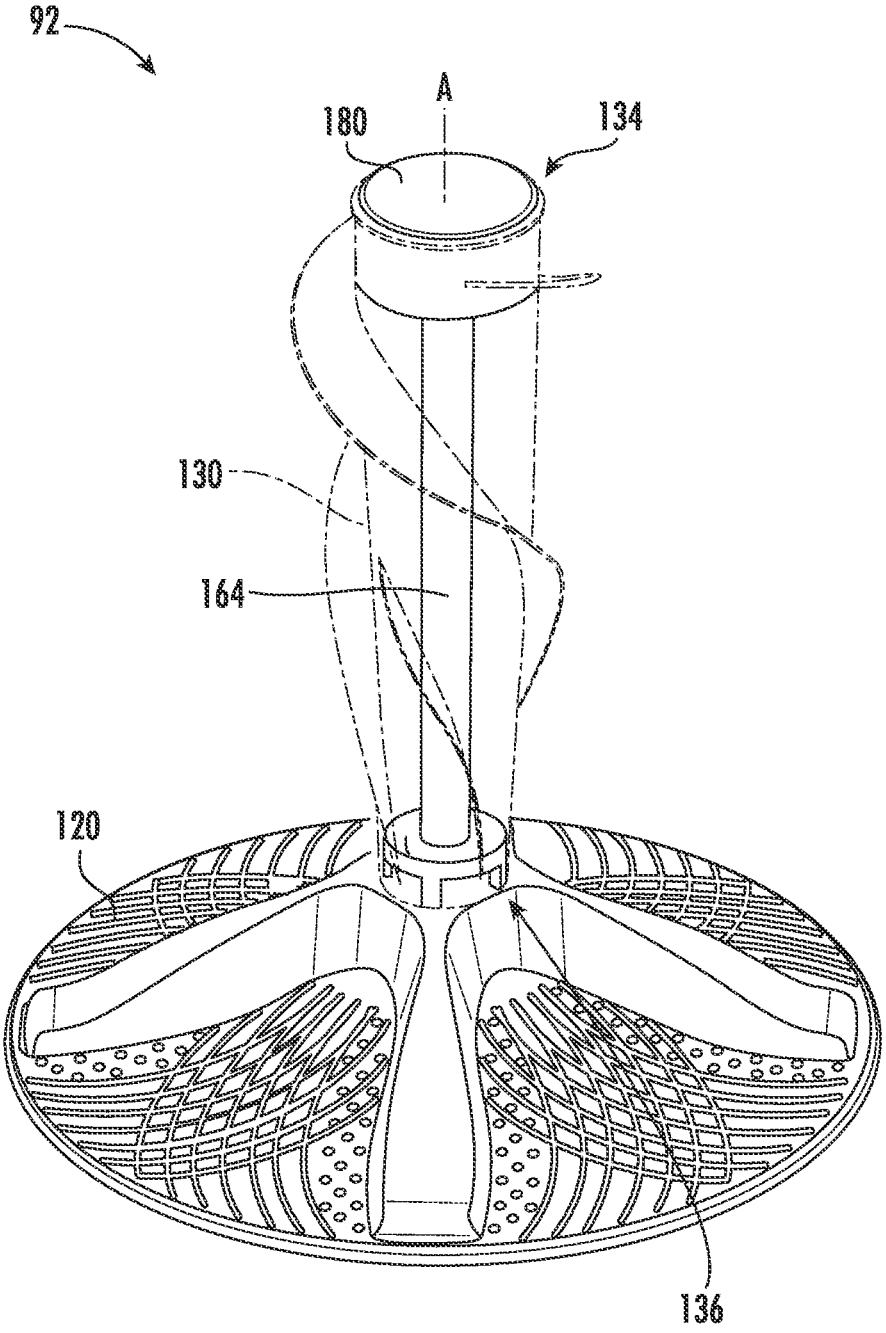
FIG. 12 provides a perspective view of an agitation element, in isolation, according to exemplary embodiments of the present disclosure.
Figure 13:
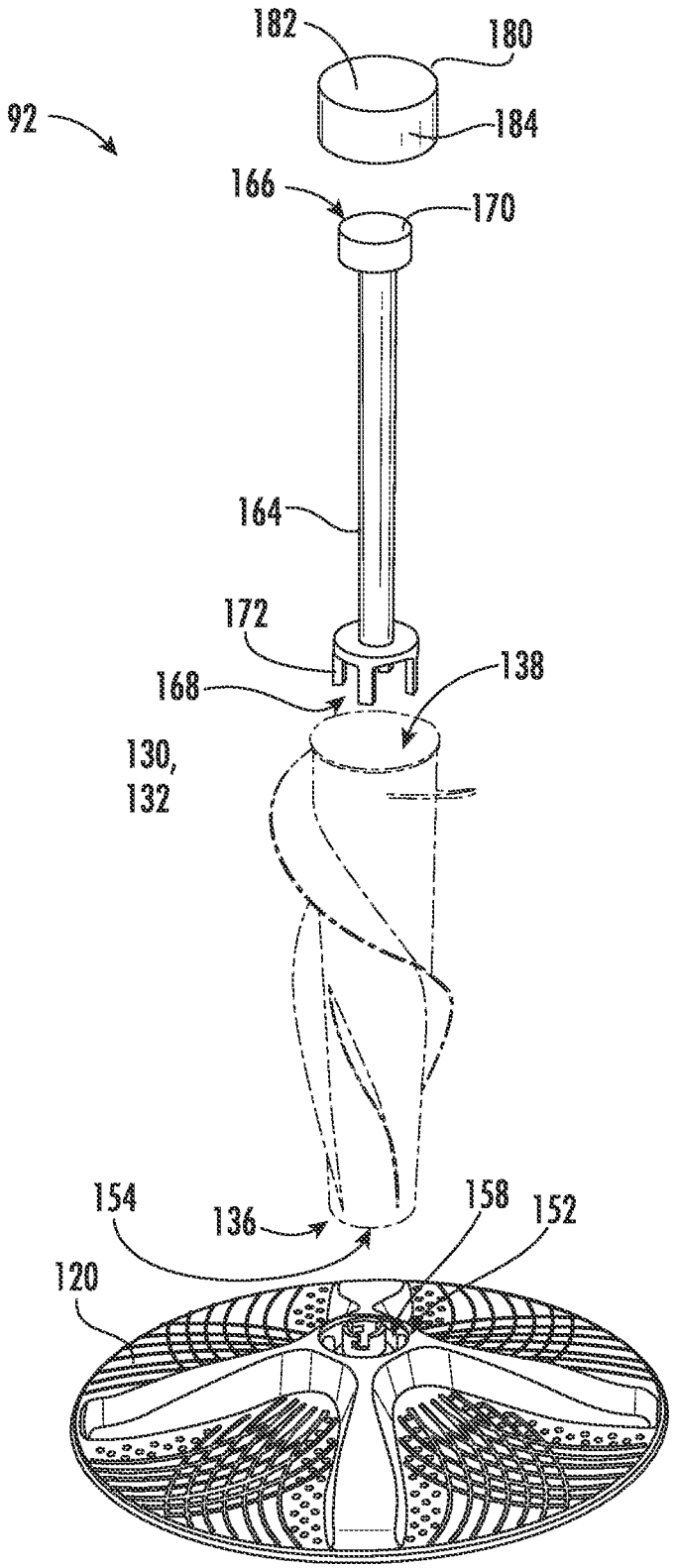
FIG. 13 provides an exploded perspective view of the exemplary agitation element of FIG. 12.
Figure 14:
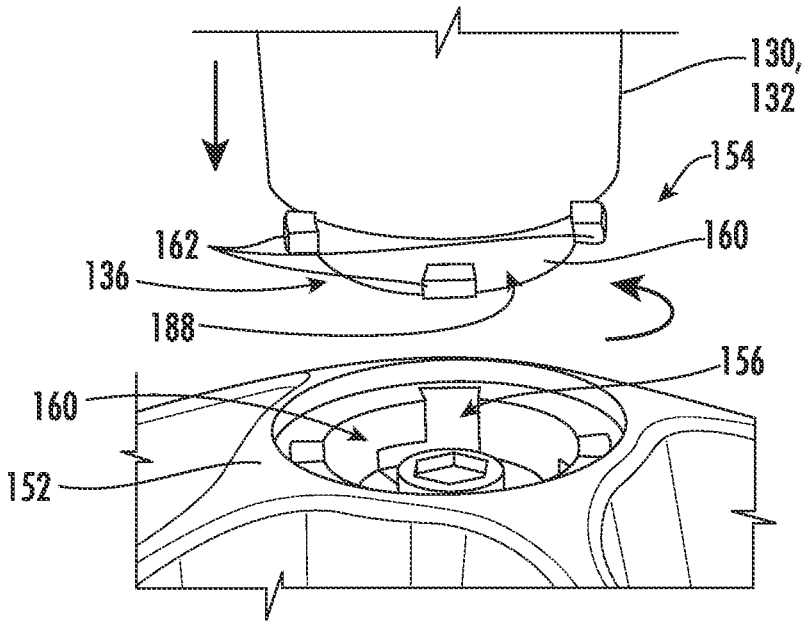
FIG. 14 provides a sectional perspective view of a bottom portion of the extended post moving toward attachment to the impeller base of the exemplary agitation element of FIG. 12.
Figure 15:
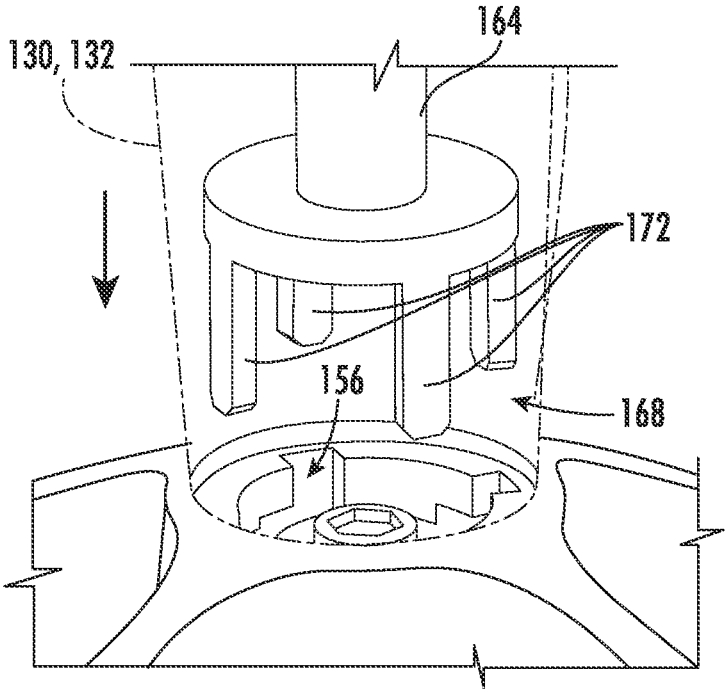
FIG. 15 provides a sectional perspective view of a bottom portion of the connector bar moving toward attachment to the impeller base of the exemplary agitation element of FIG. 12.
Figure 16:
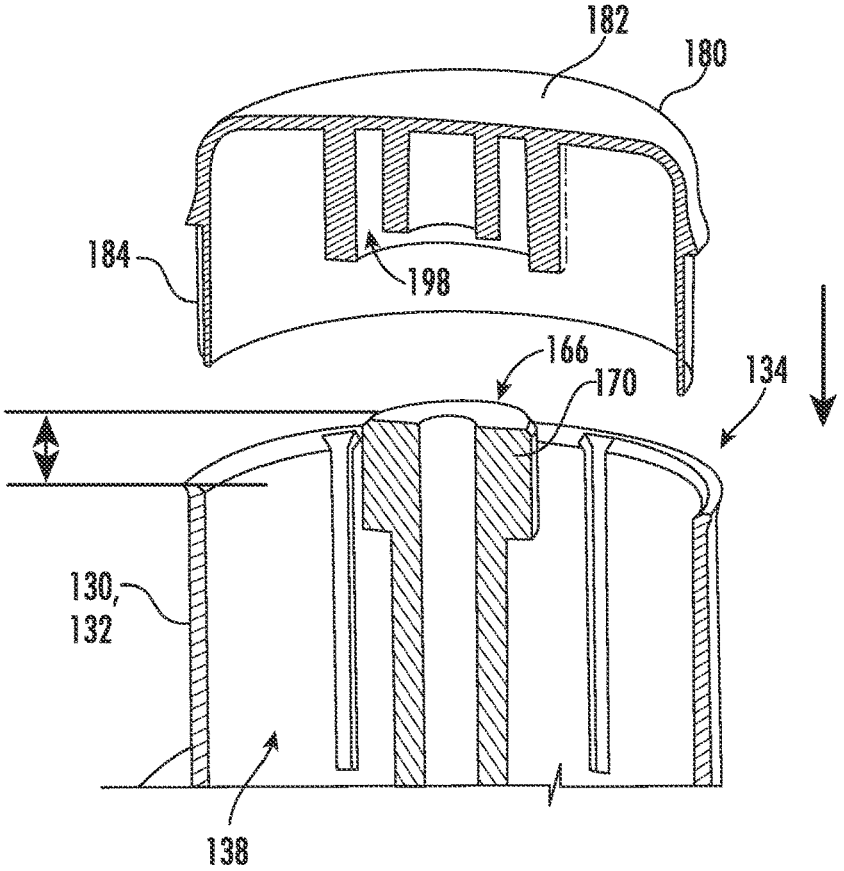
FIG. 16 provides a section perspective view of the post cap moving toward the connector bar of the exemplary agitation element of FIG. 12.
Figure 17:
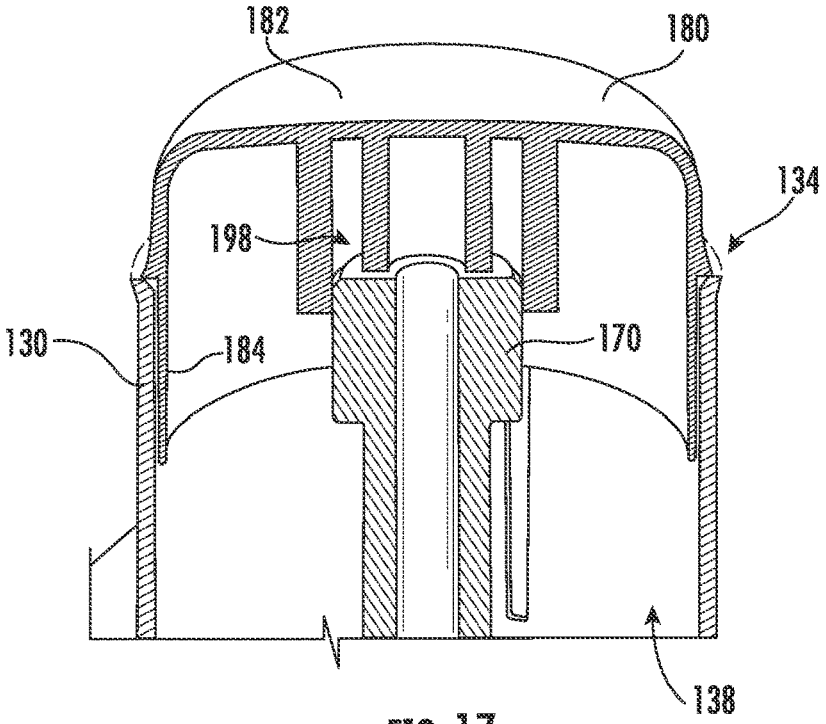
FIG. 17 provides a section perspective view of the post cap attached to the connector bar and extended post of the exemplary agitation element of FIG. 12.

Turning now to the figures, FIGS. 1 and 2 provide separate views of a washing machine appliance 50 according to exemplary embodiments of the present disclosure. As shown, washing machine appliance 50 generally defines a vertical direction V, a lateral direction L, and a transverse direction T. The vertical direction V, lateral direction L, and transverse direction T are each mutually perpendicular and form an orthogonal direction system.

Washing machine appliance 50 may include a cabinet 52 and a cover 54. A backsplash 56 extends from cover 54, and a control panel 58, including a plurality of input selectors 60, is coupled to backsplash 56.

Control panel 58 and input selectors 60 collectively form a user interface input for operator selection of machine cycles and features, and in one embodiment, a display 61 indicates selected features, a countdown timer, or other items of interest to machine users. It should be appreciated, however, that in other exemplary embodiments, the control panel 58, input selectors 60, and display 61, may have any other suitable configuration. For example, in other exemplary embodiments, one or more of the input selectors 60 may be configured as manual "push-button" input selectors, or alternatively may be configured as a touchscreen (e.g., on display 61).

A lid 62 may be mounted to cover 54 and rotatable between an open position (not shown) facilitating access to a tub, also referred to as a wash tub, 64 located within cabinet 52 and a closed position (FIG. 1) forming an enclosure over tub 64. Lid 62 in exemplary embodiment includes a transparent panel 63, which may be formed of, for example, glass, plastic, or any other suitable material. The transparency of the panel 63 allows users to see through the panel 63, and into the tub 64 when the lid 62 is in the closed position. In some embodiments, the panel 63 itself can generally form the lid 62. In other embodiments, the lid 62 includes the panel 63 and a frame 65 surrounding and encasing the panel 63. Alternatively, panel 63 need not be transparent.

As may be seen in FIG. 2, tub 64 includes a bottom wall 66 and a sidewall 68. A wash drum or basket 70 is rotatably mounted within tub 64. In particular, basket 70 is rotatable about a central axis, which may when properly balanced and positioned in the embodiment illustrated be a vertical axis. Thus, washing machine appliance is generally referred to as a vertical axis washing machine appliance. Basket 70 defines a wash chamber 73 for receipt of articles for washing and extends, for example, vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g. water) into tub 64 or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed (i.e. sprayed or poured) into the tub 64.

Various valves may regulate the flow of fluid through nozzle 72. For example, a flow regulator may be provided to control a flow of hot or cold water into the wash chamber of washing machine appliance 50. For the embodiment depicted, the flow regulator includes a hot water valve 74 and a cold water valve 75. The hot and cold water valves 74, 75 are used to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the embodiment depicted, nozzle 72 is a separate downstream component from dispenser 84. In other exemplary embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other exemplary embodiments, the washing machine appliance 50 may not include a dispenser, in which case a user may add one or more wash additives directly to wash chamber 73. A pump assembly 90 (shown schematically in FIG. 2) is located beneath tub 64 and basket 70 for gravity assisted flow to drain tub 64.

As will be described in greater detail herein, an agitation element 92 is oriented to rotate about the rotation axis A (e.g., parallel to the vertical direction V). Generally, agitation element 92 includes an impeller base 120 and extended post 130. The agitation element 92 depicted is positioned within the basket 70 to impart motion to the articles and liquid in the chamber 73 of the basket 70. More particularly, the agitation element 92 depicted is provided to impart downward motion of the articles along the rotation axis A. For example, with such a configuration, during operation of the agitation element 92 the articles may be moved downwardly along the rotation axis A at a center of the basket 70, outwardly from the center of basket 70 at the bottom portion 80 of the basket 70, then upwardly along the rotation axis A towards the top portion 82 of the basket 70.

In optional embodiments, basket 70 and agitation element 92 are both driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64 (e.g., about rotation axis A). Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a pressure sensor 110 may be positioned in the tub 64 as illustrated or, alternatively, may be remotely mounted in another location within the appliance 50 and be operationally connected to tub 64 by a hose (not shown). Any suitable pressure sensor 110, such as an electronic sensor, a manometer, or another suitable gauge or sensor, may be used. The pressure sensor 110 may generally measure the pressure of water in the tub 64. This pressure can then be used to estimate the height or amount of water in the tub 64. Additionally, a suitable speed sensor can be connected to the motor 94, such as to the output shaft 98 thereof, to measure speed and indicate operation of the motor 94. Other suitable sensors, such as temperature sensors, water sensors, moisture sensors, etc., may additionally be provided in the washing machine appliance 50.

Operation of washing machine appliance 50 is controlled by a processing device or controller 100, that is operatively coupled to the input selectors 60 located on washing machine backsplash 56 for user manipulation to select washing machine cycles and features. Controller 100 may further be operatively coupled to various other components of appliance 50, such as the flow regulator (including valves 74, 75), motor 94, pressure sensor 110, other suitable sensors, etc. In response to user manipulation of the input selectors 60, controller 100 may operate the various components of washing machine appliance 50 to execute selected machine cycles and features.

While described in the context of specific embodiments of washing machine appliance 50, using the teachings disclosed herein it will be understood that washing machine appliance 50 is provided by way of example only. Other washing machine appliances having different configurations, different appearances, or different features may also be used with the present subject matter as well.

Turning now generally to FIGS. 2 through 17, various embodiments of agitation element 92 are illustrated. In some embodiments, agitation element 92 may include or be provided as a removable agitation element having an extended post 130 selectively attached to (and removable from) impeller base 120. Generally, impeller base 120 includes an impeller platform 122 having one or more impeller fins 124 extending therefrom, as would generally be understood. In the illustrated embodiments, impeller base 120 includes four discrete impeller fins 124 that extends upward from impeller platform 122 and radially outward from rotation axis A. Nonetheless, it is understood that any suitable number of impeller fins 124 may be provided. When assembled, impeller base 120 is generally connected to or in mechanical communication with motor 94, such as through the output shaft 98. Thus, impeller base 120 may be rotated, oscillated, or otherwise motivated by motor 94 (e.g., during a washing operation or wash cycle, as directed by controller 100).

When assembled, extended post 130 may generally extend along the rotation axis A above the impeller base 120. Specifically, extended post 130 may include a base body 132 extending along the rotation axis A between a bottom end 136 and a top end 134. As shown, base body 132 may be mounted within wash chamber 73 such that bottom end 136 is attached or otherwise proximal to the impeller base 120 while top end 134 is held distal to impeller base 120. Between top end 134 and bottom end 136, one or more auger fins 150 may extend radially from extended post 130 (e.g., to engage and agitate articles within wash chamber 73). In the illustrated embodiments, auger fin 150 is formed as a helical coil wrapped about extended post 130. Nonetheless, any suitable shape or number of auger fins may be provided in alternative embodiments, as would be understood.

As shown, impeller base 120 may provide a mounting face 152 that selectively connects to a mating face 154 of extended post 130. As shown, mounting face 152 is disposed inward from the impeller fins 124. Thus, mounting face 152 may be located closer to rotation axis A than impeller fins 124. In some such embodiments, mounting face 152 is generally coaxial with rotation axis A (e.g., at a radial center of impeller base 120). At or within mounting face 152, impeller base 120 may define one or more attachment slots 156 that extend, at least in part, vertically (e.g., parallel to the rotation axis A).

Optionally, multiple attachment slots 156 may be circumferentially spaced apart from each other about the rotation axis A. Additionally or alternatively, multiple attachment slots 156 may be provided at a common (e.g., the same) radial distance from rotation axis A. In exemplary embodiments, mounting face 152 defines a recessed cup 158 directed upward such that the recessed cup 158 is open to receive, for instance, a portion of extended post 130 (e.g., a mating collar 160) from above. In some such embodiments, the attachment slots 156 are disposed and defined within the recessed cup 158. Thus, the attachment slots 156 may be open from above as discrete channels along an inner surface (e.g., facing the rotation axis A) that is within or defines the recessed cup 158.

Extended post 130 may provide a complementary structure to engage or interlock with the mounting face 152 of impeller base 120. In some embodiments, extended post 130 includes a mating face 154 disposed on bottom end 136 to rest against or interlock with the mounting face 152. Specifically, mating face 154 may include a mating collar 160 defining one or more attachment rails 162 to be selectively received within the attachment slots 156. For instance, mating collar 160 may define a plurality of attachment rails 162 that correspond to and are each received by discrete the attachment slots 156. Thus, each attachment rail 162 may correspond to a discrete attachment slot 156. Optionally, mating collar 160 may include an engagement face 188 that extends along and about the rotation axis A proximal to the bottom end 136. The attachment rails 162 from the engagement face 188. For instance, the attachment rails 162 may extend radially outward from engagement face 188, opposite or away from an interior cavity 138 defined by extended post 130. When assembled such that extended post 130 is attached to impeller base 120, each attachment rail 162 may be selectively held within a discrete attachment slot 156. Advantageously, engagement between the attachment rails 162 and attachment slots 156 may selectively and rotationally fix extended post 130 to impeller base 120. Moreover, the connection between the mounting face 152 and mating face 154 may notably resist side loads (e.g., generated by articles within wash chamber 73) and maintain the position of extended post 130 relative to impeller base 120.

Turning now especially to FIGS. 4 through 11, in some embodiments, the attachment slots 156 extend linearly and parallel to the rotation axis A. Thus, the attachment slots 156 may only permit uni-directional (e.g., up and down) movement or translation of the attachment rails 162 therein. For instance, attachment rails 162 may be inserted vertically into attachment slot 156. Once received in or engaged with the attachment slots 156, rotation of extended post 130 relative to impeller base 120 may be prevented.

As shown, a connector bar 164 may be provided to selectively restrict vertical movement of extended post 130 relative to impeller base 120. As shown, connector bar 164 may be disposed generally along the rotation axis A from a lower end 168 and an upper end 166. When extended post 130 is attached to impeller base 120, connector bar 164 may be received within an interior cavity 138 defined by base body 132. Specifically, one or more connector tabs 172 of connector bar 164 may slidably engage a portion of the impeller base 120 such that the connector tab 172 holds the extended post 130 against the impeller base 120. Such connector tabs 172 may be formed or disposed at the lower end 168. Thus, when assembled such that extended post 130 is attached to impeller base 120, lower end 168 may be disposed proximal to the impeller base 120 while upper end 166 is disposed above lower end 168, distal to impeller base 120.

In certain embodiments, impeller base 120 includes an internal collar 190 to engage connector bar 164. In particular, internal collar 190 may be disposed within the recessed cup 158 or otherwise radially inward from the attachment slots 156. For instance, internal collar 190 may extend vertically or axially upward away from impeller platform 122. Moreover, internal collar 190 may be formed concentric to or coaxial with rotation axis A. As shown, internal collar 190 may define one or more secondary slots 192 to receive the connector tabs 172. Specifically, each secondary slot 192 may define an L-shaped path having a vertical leg and a horizontal leg along which the connector tab 172 may slide. The vertical leg of the secondary slot 192 may be axially open to permit the connector tab 172 while the horizontal leg of the secondary slot 192 may be closed (e.g., at a distal end from the vertical leg) to restrict or delimit the permitted rotation of connector bar 164 within internal collar 190. Thus, attachment of connector bar 164 to impeller base 120 may require vertically inserting a connector tab 172 into a secondary slot 192, sliding connector tab 172 vertically downward, then rotating connector bar 164 about the rotation axis A and along the horizontal leg.

Each secondary slot 192 may be radially open such that each connector tab 172 may extend through and radially outward from the secondary slot 192 (e.g., when received therein). Optionally, mating collar 160 may include a bottom ring 194 (e.g., provided at the bottom end 136) to receive the internal collar 190. Bottom ring 194 may extend radially inward and, thus, provide an internal upper facing surface. As shown, when extended post 130 is held on impeller base 120, bottom ring 194 may be disposed below the secondary slots 192. In turn, connector tabs 172 may be held within the secondary slots 192 above bottom ring 194. Moreover, connector tabs 172 may bound or block bottom ring 194 (and thus extended post 130 generally) vertically. Advantageously, the connector bar 164 may notably resist vertical loads (e.g., generated by articles within wash chamber 73) and maintain the vertical position of extended post 130 relative to impeller base 120.

In some embodiments, upper end 166 of connector bar 164 may be held at substantially (e.g., within ten percent variance of) the same height or vertical location as the top end 134 of base body 132. In other words, upper end 166 may be disposed at the top end 134. In additional or alternative embodiments, an enlarged key 170 of connector bar 164 is formed on upper end 166 (e.g., to be held at top end 134). Optionally, enlarged key 170 may be formed to have and eccentric profile extending outward from a vertical rail of connector bar 164 (e.g., such that connector bar 164 is swollen at upper end 166). Additionally or alternatively, a support flange 196 may be provided within interior cavity 138 between enlarged key 170 and connector tabs 172 to slidably hold connector bar 164 within extended post 130 or along the rotation axis A.

In certain embodiments, a post cap 180 is included with agitation element 92. As shown, post cap 180 may be placed on base body 132 (e.g., at top end 134) and cover interior cavity 138. Thus, when assembled, connector bar 164 and the rest of interior cavity 138 may generally be hidden from a user's view. In some embodiments, post cap 180 includes an upper cap wall 182 (e.g., extending across rotation axis A above interior cavity 138) and a side cap wall 184 extending downward from upper cap wall 182 (e.g., to be held against or within base body 132). Side cap wall 184 may be complementary to an interior surface of base body 132 or may otherwise include one or more mechanical fasteners (e.g., tabs, clips, shoulders, etc.) to rotationally fix post cap 180 relative to base body 132, such as in friction fit engagement. Thus, during use, post cap 180 may be attached to extended post 130 in rotationally fixed engagement. When placed on base body 132, side cap wall 184 may thus be prevented from rotating relative to the rest of extended post 130.

Optionally, post cap 180 may include a pocket 198 to hold enlarged key 170. Thus, at least a portion of enlarged key 170 may connect to or be received within post cap 180. When received within or connected post cap 180, enlarged key 170 may be moved or held generally in place relative to extended post 130. For instance, friction fit engagement between post cap 180 and base body 132 may restrict rotation or axial movement of connector bar 164.

Turning now especially to FIGS. 12 through 17, in some embodiments, the attachment slots 156 define an L-shaped path having a vertical leg and a horizontal leg along which the attachment rail 162 may slide. Thus, the attachment slots 156 may permit discrete vertical movements and horizontal movements (e.g., rotation) of the attachment rails 162 therein. The vertical leg of each attachment slot 156 may be axially open to permit the corresponding attachment rail 162 while the horizontal leg of the L-shaped path may be closed (e.g., at a distal end from the vertical leg) to restrict or delimit the permitted rotation of mating collar 160 within recessed cup 158. Thus, attachment of extended post 130 to impeller base 120 may require vertically inserting an attachment rail 162 into an attachment slot 156, sliding attachment rail 162 vertically downward, then rotating extended post 130 about the rotation axis A and along the horizontal leg.

As shown, a connector bar 164 may be provided to selectively restrict vertical movement of extended post 130 relative to impeller base 120. As shown, connector bar 164 may be disposed generally along the rotation axis A from a lower end 168 and an upper end 166. When extended post 130 is attached to impeller base 120, connector bar 164 may be received within an interior cavity 138 defined by base body 132. Specifically, one or more connector tabs 172 of connector bar 164 may slidably engage a portion of the impeller base 120 such that the connector tab 172 holds the extended post 130 against the impeller base 120. Such connector tabs 172 may be formed or disposed at the lower end 168. Thus, when assembled such that extended post 130 is attached to impeller base 120, lower end 168 may be disposed proximal to the impeller base 120 while upper end 166 is disposed above lower end 168, distal to impeller base 120.

In certain embodiments, connector tabs 172 can be selectively received within a portion of the attachment slots 156 (e.g., to slide therein). Specifically, each connector tab 172 may slide vertically into the vertical leg of a corresponding attachment slot 156. When extended post 130 is attached to impeller base 120 such that the attachment rails 162 are received within the horizontal legs of the attachment slots 156, the connector tabs 172 may slide into (and held within) the vertical legs of the attachment slots 156. In turn, the connector tabs 172 may block or restrict further rotation of the attachment rails 162 (and extended post 130 generally) while the attachment slots 156 block or restrict vertical movement of the attachment rails 162 (and extended post 130 generally). Advantageously, the extended post 130 may thus resist vertical loads (e.g., generated by articles within wash chamber 73) and maintain the vertical position of extended post 130 relative to impeller base 120.

In some embodiments, upper end 166 of connector bar 164 may be held at substantially (e.g., within ten percent variance of) the same height or vertical location as the top end 134 of base body 132. In other words, upper end 166 may be disposed at the top end 134. In additional or alternative embodiments, an enlarged key 170 of connector bar 164 is formed on upper end 166 (e.g., to be held at top end 134). Optionally, enlarged key 170 may be formed to have and eccentric profile extending outward from a vertical rail of connector bar 164 (e.g., such that connector bar 164 is swollen at upper end 166).

In certain embodiments, a post cap 180 is included with agitation element 92. As shown, post cap 180 may be placed on base body 132 (e.g., at top end 134) and cover interior cavity 138. Thus, when assembled, connector bar 164 and the rest of interior cavity 138 may generally be hidden from a user's view. In some embodiments, post cap 180 includes an upper cap wall 182 (e.g., extending across rotation axis A above interior cavity 138) and a side cap wall 184 extending downward from upper cap wall 182 (e.g., to be held against or within base body 132). Side cap wall 184 may be complementary to an interior surface of base body 132 or may otherwise include one or more mechanical fasteners (e.g., tabs, clips, shoulders, etc.) to rotationally fix post cap 180 relative to base body 132, such as in friction fit engagement. Thus, during use, post cap 180 may be attached to extended post 130 in rotationally fixed engagement. When placed on base body 132, side cap wall 184 may thus be prevented from rotating relative to the rest of extended post 130.

Optionally, post cap 180 may include a pocket 198 to hold enlarged key 170. Thus, at least a portion of enlarged key 170 may connect to or be received within post cap 180. When received within or connected post cap 180, enlarged key 170 may be moved or held generally in place relative to extended post 130. For instance, friction fit engagement between post cap 180 and base body 132 may restrict rotation or axial movement of connector bar 164.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:
a tub;
a basket rotatably positioned within the tub;
an impeller base rotatably mounted within the basket and defining a rotation axis, the impeller base comprising
one or more impeller fins extending radially outward from the rotation axis, and
a mounting face disposed radially inward from the one or more impeller fins, the mounting face comprising a mounting bracket defining one or more attachment slots extending vertically;
an extended post removably attached to the impeller base to rotate therewith, the extended post comprising
a base body extending along the rotation axis between a bottom end proximal to the impeller base and a top end distal to the impeller base, the base body defining an interior cavity from the bottom end to the top end,
an auger fin extending radially from the base body between the bottom end and the top end, and
a mating face disposed on the bottom end, the mating face comprising a mating collar defining one or more attachment rails corresponding to and selectively received within the one or more attachment slots; and
a connector bar selectively received within the interior cavity and extending along the rotation axis between a lower end and an upper end, the lower end comprising a connector tab to slidably engage the impeller base, the connector tab holding the extended post against the impeller base,
wherein the impeller base further comprises an internal collar disposed radially inward from the attachment slots and received within the interior cavity of the base body,
wherein the internal collar defines a secondary slot to receive the connector tab therein,
wherein the mating collar further comprises a bottom ring at the bottom end to receive the internal collar, and
wherein the connector tab and secondary slot are disposed above the bottom ring.

2. The washing machine appliance of claim 1, wherein each attachment slot extends linearly and parallel to the rotation axis.

3. The washing machine appliance of claim 1, wherein the secondary slot defines an L-shaped path along which the connector tab slides.

4. The washing machine appliance of claim 1, wherein the upper end of the connector bar comprises an enlarged key held at the top end of the base body.

5. The washing machine appliance of claim 4, further comprising a post cap selectively covering the interior cavity of the extended post at the top end.

6. The washing machine appliance of claim 5, wherein the post cap holds the enlarged key to selectively direct the connector bar about the rotation axis.

7. The washing machine appliance of claim 1, wherein each attachment slot defines an L-shaped path along which one of the attachment rails slides.

8. The washing machine appliance of claim 7, wherein the connector tab is vertically received within at least one attachment slot to block at least one attachment rail therein.

9. The washing machine appliance of claim 1, further comprising a post cap selectively covering the interior cavity of the extended post at the top end.

10. A washing machine appliance comprising:
a tub;
a basket rotatably positioned within the tub;
an impeller base rotatably mounted within the basket and defining a rotation axis, the impeller base comprising
one or more impeller fins extending radially outward from the rotation axis, and
a mounting face disposed radially inward from the one or more impeller fins, the mounting face comprising a mounting bracket defining one or more attachment slots extending vertically;
an extended post removably attached to the impeller base to rotate therewith, the extended post comprising
a base body extending along the rotation axis between a bottom end proximal to the impeller base and a top end distal to the impeller base, the base body defining an interior cavity from the bottom end to the top end,
an auger fin extending radially from the base body between the bottom end and the top end, and
a mating face disposed on the bottom end, the mating face comprising a mating collar defining one or more attachment rails corresponding to and selectively received within the one or more attachment slots, the attachment rails extending radially outward from the mating collar;
a connector bar selectively received within the interior cavity and extending along the rotation axis between a lower end and an upper end, the lower end comprising a connector tab to slidably engage the impeller base, the connector tab holding the extended post against the impeller base; and
a post cap selectively covering the interior cavity of the extended post at the top end,
wherein the impeller base further comprises an internal collar disposed radially inward from the attachment slots and received within the interior cavity of the base body,
wherein the internal collar defines a secondary slot to receive the connector tab therein,
wherein the mating collar further comprises a bottom ring at the bottom end to receive the internal collar, and
wherein the connector tab and secondary slot are disposed above the bottom ring.

11. The washing machine appliance of claim 10, wherein each attachment slot extends linearly and parallel to the rotation axis.

12. The washing machine appliance of claim 10, wherein the secondary slot defines an L-shaped path along which the connector tab slides.

13. The washing machine appliance of claim 10, wherein the upper end of the connector bar comprises an enlarged key held at the top end of the base body.

14. The washing machine appliance of claim 13, wherein the post cap holds the enlarged key to selectively direct the connector bar about the rotation axis.

15. The washing machine appliance of claim 10, wherein each attachment slot defines an L-shaped path along which one of the attachment rails slides.

16. The washing machine appliance of claim 15, wherein the connector tab is vertically received within at least one attachment slot to block at least one attachment rail therein.

17. A washing machine appliance comprising:
a tub;
a basket rotatably positioned within the tub;
an impeller base rotatably mounted within the basket and defining a rotation axis, the impeller base comprising one or more impeller fins extending radially outward from the rotation axis, and a mounting face disposed radially inward from the one or more impeller fins, the mounting face comprising a mounting bracket defining one or more attachment slots extending vertically;

an extended post removably attached to the impeller base to rotate therewith, the extended post comprising a base body extending along the rotation axis between a bottom end proximal to the impeller base and a top end distal to the impeller base, the base body defining an interior cavity from the bottom end to the top end, an auger fin extending radially from the base body between the bottom end and the top end, and a mating face disposed on the bottom end, the mating face comprising a mating collar defining one or more attachment rails corresponding to and selectively received within the one or more attachment slots;

a connector bar selectively received within the interior cavity and extending along the rotation axis between a lower end and an upper end, the lower end comprising a connector tab to slidably engage the impeller base, the connector tab holding the extended post against the impeller base; and a post cap selectively covering the interior cavity of the extended post at the top end, wherein the upper end of the connector bar comprises an enlarged key held at the top end of the base body, and wherein the post cap holds the enlarged key to selectively direct the connector bar about the rotation axis.

18. The washing machine appliance of claim 17, wherein each attachment slot extends linearly and parallel to the rotation axis.

19. The washing machine appliance of claim 17, wherein each attachment slot defines an L-shaped path along which one of the attachment rails slides.

20. The washing machine appliance of claim 19, wherein the connector tab is vertically received within at least one attachment slot to block at least one attachment rail therein.

* * * * *